US009297529B2

(12) United States Patent
Blaschke

(10) Patent No.: US 9,297,529 B2
(45) Date of Patent: Mar. 29, 2016

(54) EVAPORATOR ASSEMBLY UNIT, ESPECIALLY FOR A VEHICLE HEATER

(75) Inventor: Walter Blaschke, Deizisau (DE)

(73) Assignee: Eberspächer Climate Control Systems GmbH & Co. KG, Esslingen (DE)

( * ) Notice: Subject to any disclaimer, the term of this patent is extended or adjusted under 35 U.S.C. 154(b) by 450 days.

(21) Appl. No.: 13/527,681

(22) Filed: Jun. 20, 2012

(65) Prior Publication Data

US 2012/0328997 A1 Dec. 27, 2012

(30) Foreign Application Priority Data

Jun. 21, 2011 (DE) ..... 10 2011 077 891

(51) Int. Cl.

| | |
|---|---|
| ***F24D 1/00*** | (2006.01) |
| ***B60H 1/22*** | (2006.01) |
| ***F23D 3/18*** | (2006.01) |
| ***F23D 3/40*** | (2006.01) |

(52) U.S. Cl.

CPC ..... *F23D 3/40* (2013.01); *F23D 2900/21002* (2013.01)

(58) Field of Classification Search

CPC ..... F23D 11/448; F23D 3/40; F23D 2900/21002; B60H 2001/2271; B60H 1/22

USPC ..... 431/208, 259

See application file for complete search history.

(56) References Cited

U.S. PATENT DOCUMENTS

| | | | | |
|---|---|---|---|---|
| 1,956,240 | A * | 4/1934 | Ludwig | 219/270 |
| 3,256,417 | A * | 6/1966 | Merrett | 219/675 |
| 3,458,766 | A * | 7/1969 | Little | 219/260 |
| 3,681,737 | A * | 8/1972 | Magnusson et al. | 338/262 |
| 4,318,689 | A * | 3/1982 | Forster et al. | 431/208 |
| 4,538,985 | A | 9/1985 | Zwicker | |
| 4,789,331 | A | 12/1988 | Kawamura | |
| 5,088,918 | A | 2/1992 | Schaale et al. | |
| 5,722,588 | A * | 3/1998 | Inoue et al. | 237/12.3 C |
| 5,993,197 | A | 11/1999 | Alber et al. | |
| 6,347,936 | B1 | 2/2002 | Young et al. | |
| 6,988,885 | B2 * | 1/2006 | Blaschke et al. | 431/161 |
| 2004/0146825 | A1 | 7/2004 | Kramer et al. | |
| 2007/0295708 | A1 * | 12/2007 | Yu et al. | 219/260 |
| 2010/0323313 | A1 * | 12/2010 | Toriya et al. | 432/200 |

FOREIGN PATENT DOCUMENTS

| | | | |
|---|---|---|---|
| CN | 2252896 | Y | 4/1997 |
| DE | 32 33 319 | A1 | 3/1984 |

(Continued)

OTHER PUBLICATIONS

Jiang Zhiping; Rhine, Wendell. "Synthesis and Pyrolysis of Novel Polymeric Precursors to TiC/Al2O3, TiN/Al2o3, and AIN/TiN Nanocomposites" 1994. American Society. pp. 1080-1086.*

(Continued)

*Primary Examiner* — Steven B McAllister

*Assistant Examiner* — Rabeeul Zuberi

(74) *Attorney, Agent, or Firm* — McGlew and Tuttle, P.C.

(57) ABSTRACT

An evaporator assembly unit, especially for a vehicle heater, includes an evaporator medium carrier (12) with a bottom wall (14), a porous evaporator medium (18) provided on one side of the bottom wall (14) and an electrically excitable ignition element (34). The ignition element is embedded in the material of which the bottom wall (14) is made.

16 Claims, 1 Drawing Sheet

(56) References Cited

FOREIGN PATENT DOCUMENTS

| | | | | |
|---|---|---|---|---|
| DE | 37 22 093 | A1 | 1/1988 | |
| DE | 40 03 090 | C1 | 6/1991 | |
| DE | 44 01 799 | C1 | 6/1995 | |
| DE | 197 03 555 | A1 | 8/1998 | |
| DE | 100 05 376 | A1 | 8/2000 | |
| DE | 102 51 438 | B3 | 1/2004 | |
| DE | 103 25 574 | A1 | 12/2004 | |
| DE | 103 46 558 | B3 | 3/2005 | |
| DE | 10344979 | A1 | 4/2005 | |
| DE | 10 2004 005 267 | A1 | 8/2005 | |
| DE | 10 2009 003383 | A1 | 8/2010 | |
| EP | 1 275 901 | A2 | 1/2003 | |
| EP | 1 568 525 | A1 | 8/2005 | |
| EP | 1568525 | A1 * | 8/2005 | ..... B60H 1/22 |

OTHER PUBLICATIONS

European Search Report of Jul. 17, 2015.

* cited by examiner

EVAPORATOR ASSEMBLY UNIT, ESPECIALLY FOR A VEHICLE HEATER

CROSS REFERENCE TO RELATED APPLICATIONS

This application claims the benefit of priority under 35 U.S.C. §119 of German Patent Application DE 10 2011 077 891.8, filed on Jun. 21, 2011, the entire contents of which is incorporated herein by reference.

FIELD OF THE INVENTION

The present invention pertains to an evaporator assembly unit, especially for a vehicle heater, comprising an evaporator medium carrier with a bottom wall, a porous evaporator medium provided on one side of the bottom wall, and an electrically excitable ignition element.

BACKGROUND OF THE INVENTION

An evaporator assembly unit is known from EP 1 568 525, in which a porous evaporator medium is applied in the form of a nonwoven layer to an evaporator medium carrier made of a ceramic material with good heat conductivity. A heating assembly unit, which has an evaporating heating element provided with a heat conductor extending in a meandering manner at a carrier body, is provided on the rear side of the evaporator medium carrier. This heating element is in contact with the rear side of the evaporator medium carrier and thus heats this and the porous evaporator medium applied to the front side of said evaporator medium carrier, so that the evaporation of fuel from this is supported. A projection, which extends at right angles to the carrier body and which carries on its outer circumference a heat conductor of an ignition element, which said heat conductor is likewise winding in a meandering manner, is provided at the carrier body. This projection meshes with a corresponding, hollow projection on the evaporator medium carrier and is thus located in a recess formed in the porous evaporator medium. The ignition element, on the one hand, and the evaporating heating element, on the other hand, may be excited electrically independently from each other to provide the condition for ignition and to provide an evaporation support heating.

EP 1 275 901 A2 discloses an evaporator burner for a vehicle heater, in which a pot-shaped evaporator medium carrier carries a multilayer porous evaporator medium on one side of a bottom wall of said evaporator medium carrier. On a rear side facing away from this side, an evaporation heating element with a heat conductor winding in a meandering manner is provided in a depression. To ignite the fuel/air mixture generated in a combustion chamber, an ignition element designed in the form of a glow plug passes through the bottom wall in a recess provided therefor and also the porous evaporator medium in a recess provided therefor and thus extends into the inner volume area of a combustion chamber.

SUMMARY OF THE INVENTION

An object of the present invention is to provide an evaporator assembly unit, especially for a vehicle heater, which has a simple and compact design and nevertheless guarantees improved combustion and ignition characteristics.

This object is accomplished according to the present invention by an evaporator assembly unit, especially for a vehicle heater, comprising an evaporator medium carrier with a bottom wall, and porous evaporator medium provided on one side of the bottom wall and an electrically excitable (actuatable) ignition element.

Provisions are, furthermore, made for the ignition element to be embedded in the material of which the bottom wall is made.

In the design according to the present invention, the ignition element is embedded into the material of which the bottom wall of the evaporator medium carrier is made. This means that this material used surrounds the ignition element at least in the essential area of its surface, especially on its side facing one side of the bottom wall. This means that the ignition element does not pass through either the evaporator medium carrier or the porous evaporator medium. It is thus possible, in particular, to avoid a recess, which is otherwise to be formed in the area of the porous evaporator medium, which improves the fuel distribution characteristic of the porous evaporator medium, on the one hand, because there are no recess areas, through which the fuel cannot flow. On the other hand, an enlarged fuel evaporation surface of the evaporator medium is obtained while there is nonetheless a very good thermal interaction between the ignition element and the porous evaporator medium or the fuel evaporated therefrom.

Provisions may be made in an especially advantageous variant of the evaporator assembly unit according to the present invention for an electrically excitable evaporating heating element to be embedded in the material of which the bottom wall is made. Consequently, the evaporating heating element is handled in this case in the same manner in terms of manufacturing engineering as the ignition element, so that, for example, these two electrically excitable elements can be embedded in the bottom wall in one operation, for example, during the manufacture of the evaporator medium carrier in a sintering operation.

To achieve uniform thermal interaction, the evaporating heating element and the ignition element may be positioned essentially at the same embedding level in the bottom wall. Provisions may now be made, in particular, for the thickness of the material of the bottom wall between the evaporating heating element and a surface of the bottom wall formed on one side to correspond essentially to the thickness of the material of the bottom wall between the ignition element and the surface.

A uniform fuel evaporation characteristic can, furthermore, be supported by the evaporating heating element surrounding a liquid inlet opening area in the bottom wall. Provisions can now advantageously be made in case of such a design of the evaporating heating element for the ignition element to be arranged in a circular segment interruption area of the evaporating heating element. The bottom wall or the surface of the bottom wall, which surface is formed on one side thereof, can thus be utilized in a more efficient manner.

The ignition element may be disk-shaped, preferably a circular disk-shape, so that, just as the evaporating heating element, it cannot be considered, for example, to be a heating conductor wound in a meandering pattern but a heating element extending flatly.

To make it possible to further improve the ignition characteristic, an igniting air inlet opening passing through the bottom wall may be provided. If provisions are also made in this case for the igniting air inlet opening to pass through the ignition element, it is ensured at the same time that the igniting air enters and is made available in the volume area in which the thermal conditions necessary for the ignition are also made available by the ignition element.

It is advantageous, especially if the ignition element and the evaporating heating element are designed as flat elements, if the ignition element or/and evaporating heating element is made of conductive ceramic material, e.g., titanium nitride material, preferably $Al_2O_3$/TiN.

In order to achieve electrical insulation of the ignition element and of the evaporating heating element, in case these are embedded, in as simple manner, it is proposed that the evaporator medium carrier be made of insulating ceramic material. For example, aluminum oxide material, i.e., $Al_2O_3$, may be used in this case to make the evaporator medium carrier.

The porous evaporator medium may be made, for example, of metal foam material. This may be fixed on one side of the evaporator medium carrier or of the bottom wall thereof to achieve a better thermal contact.

The present invention pertains, furthermore, to an evaporator burner, especially for a vehicle heater with an evaporator assembly unit in accordance with the invention.

The present invention will be described in detail below with reference to the attached figures. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
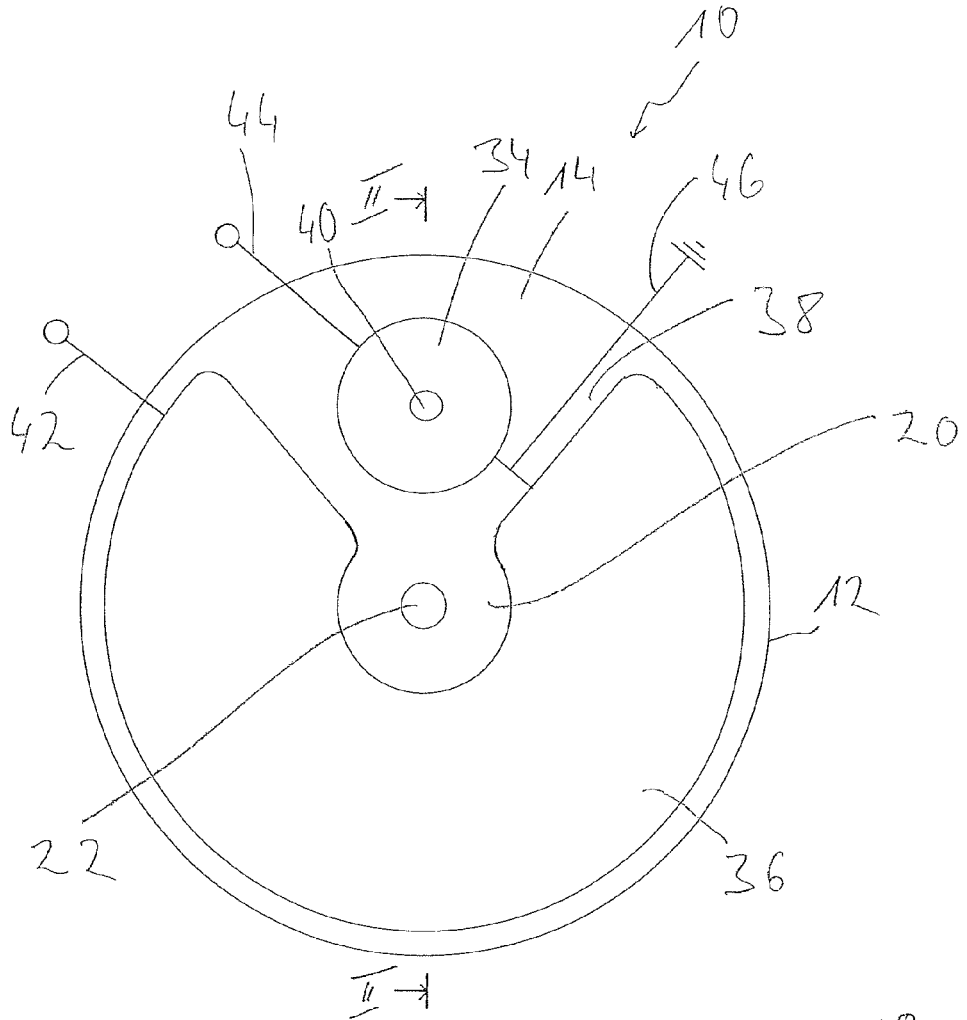
FIG. 1 is a cross-sectional view of an evaporator assembly unit, cut along a line I-I in FIG. 2.
Figure 2:
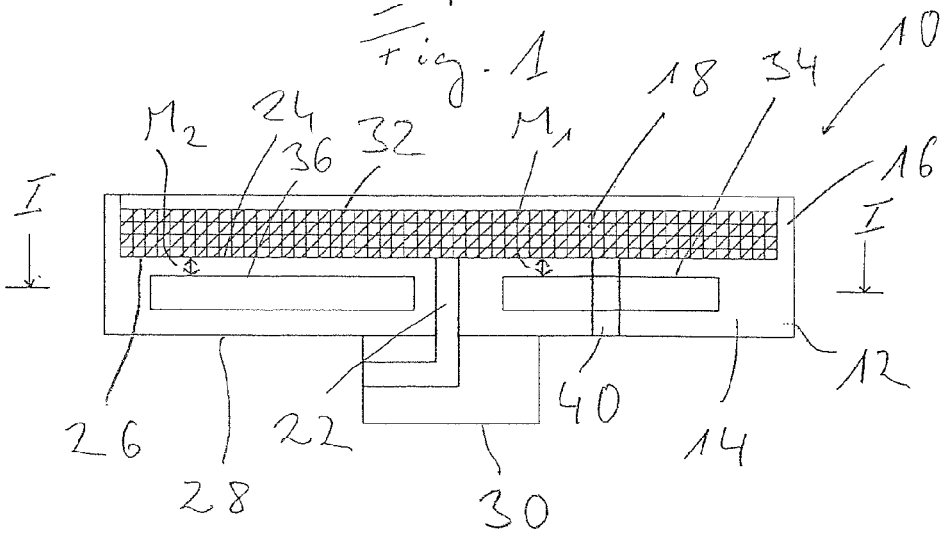
FIG. 2 is a longitudinal sectional view of the evaporator assembly unit according to FIG. 1, cut along a line II-II in FIG. 1.

Referring to the drawings in particular, an evaporator assembly unit is generally designated by reference number 10 in FIGS. 1 and 2. The evaporator assembly unit 10 comprises an evaporator medium carrier 12, which is preferably of a shell-like design in this case, with a bottom wall 14 and a circumferential wall 16. A porous evaporator medium 18, which is preferably made of a metal foam material, is arranged in the volume area enclosed by the bottom wall 14 and the circumferential wall 16. Ceramic foam material may also be used. The porosity of the porous evaporator medium may be in a range higher than 90%, especially if these materials are used. It is, of course, also possible to use other evaporator media, e.g., nonwoven or braded material or the like, or a multilayer structure.

A fuel inlet opening 22, which passes through the bottom wall 14 and reaches the rear side 26 of the evaporator medium 18, which said rear side is in contact with a surface 24 of the bottom wall 14 and, for example, faces away from a combustion chamber, is provided in a central fuel inlet area 20 located centrally in the bottom wall 14. A fuel feed line 30 may be provided or fixed at the bottom wall 14 on a rear side 28 facing away from the porous evaporator medium 18. Liquid fuel or generally a medium to be evaporated can thus be introduced into a central area of the disk-shaped porous evaporator medium 18, which has, for example, a circular outer circumferential contour, distributed there by capillary effect and possibly also under the action of gravity, and then evaporated on a front side 32 of the porous evaporator medium 18, which said front side is arranged such that it faces a combustion chamber.

A disk-shaped and electrically excitable ignition element 34, which likewise has, for example, a circular outer circumferential contour, is embedded in the bottom wall 14 of the evaporator medium carrier 12. Furthermore, an evaporation heating element 36 is embedded in the bottom wall 14 of the evaporator medium carrier in the same embedding plane area as the ignition element 34. The evaporating heating element 36 is ring segment-shaped and partially surrounds the fuel inlet area 20 or fuel inlet opening 22 preferably concentrically. The ignition element 34 is positioned in a ring segment interruption area 38, so that essentially the entire area surrounding the fuel inlet area 20 in the bottom wall 14 can be used to accommodate the two electrically excitable elements 34, 36.

An igniting air inlet opening 40 passes through the bottom wall 14 and the ignition element 34 preferably in a central area of the ignition element 34. The igniting air inlet opening 40, provided in an area in which the ignition element 34, is received or embedded in the bottom wall 14.

To contact the two electrically excitable elements 34, 36 electrically, these may be in connection with a respective actuating terminal 42 and 44, which passes through the bottom wall 14 and projects therefrom, which can be connected to an actuating device to apply an exciting voltage. It becomes possible via a common ground terminal 46, which is connected to the two electrically excitable elements 34, 36 and likewise passes through the bottom wall 14 and the evaporator medium carrier 12, to provide defined potential conditions.

Ignition element 34 and evaporating heating element 36 are provided, as is illustrated in FIG. 1, as flat, i.e., ring segment-like or circular disk-shaped heating elements. These make possible the heating of the bottom wall 14 over a large area and thus uniform fuel evaporation, for example, compared to heating conductor elements wound in a meandering pattern. Ignition element 34 and evaporating heating element 36 may be manufactured for this purpose, for example, with a conductive ceramic material, e.g., $Al_2O_3$/TiN, $Si_3N_4$/TiN or ITO according to a sintering method, a screen printing method or a powder injection molding method. The conductivity of the ignition element 34 and of the evaporating heating element 36 can be influenced by varying the percentage of titanium in the aluminum oxide.

The embedding of the ignition element 34 and of the evaporating heating element 36 in the evaporator medium carrier 12 can be achieved by the evaporator medium carrier 12, preferably made of insulating ceramic material, e.g., $Al_2O_3$, being produced in a sintering operation. The two electrically excitable elements 34, 36 being inserted into the powdered material to be sintered and also covered with this material, so that the embedding position recognizable in FIG. 2 is obtained. The material thickness $M_1$ between the side of the ignition element 34 facing the porous evaporator medium 18 and the surface 24 is preferably essentially exactly equal to a material thickness $M_2$ between the side of the evaporating heating element 36 facing the porous evaporator medium 18 and the surface 24. Uniform thermal interaction can thus be guaranteed between these two electrically excitable elements 34, 36, on the one hand, and the porous evaporator medium 18, on the other hand. Furthermore, the igniting air inlet opening 40 ensures that a sufficient amount of air, which is already preheated by the ignition element 34 itself, is available in the volume area of a combustion chamber in which the ignition element 34 provides sufficiently high temperatures for the ignition.

The fuel feed line 30 may be connected to the evaporator medium carrier 12, for example, by soldering; a metallic material may be vapor deposited for this purpose on the evaporator medium carrier 12 where this soldering shall take place in order to achieve a higher strength of connection. Other types of connection, such as sintering or screwing the fuel feed line 30 into the evaporator medium carrier 12, are possible as well.

By embedding especially the ignition element 34 in the evaporator medium carrier 12, passage openings are avoided in the porous evaporator medium 18, so that this provides an enlarged surface 32 for evaporating fuel, on the one hand, and, on the other hand, the fuel distribution characteristic is not compromised in the inner volume of the porous evaporator medium 18. Furthermore, a compact assembly unit is created, which can be integrated as an assembly unit, for example, in an evaporator burner of a vehicle heater. The risk of damage to the ignition element 34 or evaporating heating element 36 is eliminated due to their being embedded in the evaporator medium carrier 12.

It shall be pointed out in this connection that embedding means in the sense of the present invention that ignition element 34 and evaporating heating element 36 are surrounded essentially over part of their surface areas and preferably over their entire surface by the material of which the evaporator medium carrier 12 is made, for example, by their being also introduced into the material of which the evaporator medium carrier 12 is made during the manufacture of said evaporator medium carrier 12. It is, of course, equally possible, for example, to spare areas for electric contacting or to lead the terminals, recognizable in FIG. 1, on the evaporator medium carrier 12.

The compact design can be further supported by the porous evaporator medium 18 being also fixed on the surface 24 or inner circumferential surface of the circumferential wall 16 preferably by a connection in material, for example, by soldering.

It shall be pointed out that the ignition element 34 or/and evaporating heating element 36 may, of course, have different geometric shapes that are recognizable in FIG. 1. In particular, ignition element 34 could also be designed as a ring segment, which essentially fills the ring segment interruption area 38 while maintaining an interruption from the evaporation heating member 36. The area percentage of the ignition element 34 or of the evaporating heating element 36 may also be different than shown, and provisions should now be made, in principle, for the evaporating heating element 36 to cover and heat the larger surface area of the surface 24, i.e., to consequently have a larger surface located facing the surface 24, and even though the ignition element 34 is operated, for example, with a higher excitation voltage to provide higher temperatures, it shall provide these higher temperatures, in principle, in a locally limited area only.

While specific embodiments of the invention have been shown and described in detail to illustrate the application of the principles of the invention, it will be understood that the invention may be embodied otherwise without departing from such principles.

What is claimed is:

1. An evaporator assembly unit comprising:

an evaporator medium carrier with a bottom wall;

a porous evaporator medium provided on one side of said bottom wall;

an electrically excitable disk-shaped ignition element embedded within said bottom wall, said evaporator medium carrier comprising an igniting air inlet opening passing through said bottom wall, wherein said igniting air inlet opening passes through said ignition element; and an electrically excitable evaporating heating element embedded within said bottom wall, said evaporating heating element and said ignition element being positioned essentially in a same embedding plane in said bottom wall such that said ignition element does not extend into said porous evaporator medium, said evaporator heating element for heating and evaporating a liquid fuel in said porous evaporator medium.

2. An evaporator assembly unit in accordance with claim 1, wherein a material thickness of said bottom wall between said evaporating heating element and a surface of said bottom wall, which surface is formed on one side, essentially corresponds to a material thickness of said bottom wall between said ignition element and said surface of said bottom wall.

3. An evaporator assembly unit in accordance with claim 1, wherein:

said bottom wall comprises a liquid inlet opening area; and said evaporating heating element comprises a circle segment shape and at least partially surrounds said liquid inlet opening area.

4. An evaporator assembly unit in accordance with claim 3, wherein:

said circle segment shape of said evaporating heating element provides a circle segment interruption area; and said ignition element is arranged in said circle segment interruption area of said evaporating heating element.

5. An evaporator assembly unit in accordance with claim 1, wherein at least one of said ignition element and said evaporating heating element is made of a conductive ceramic material.

6. An evaporator assembly unit in accordance with claim 1, wherein at least one of said ignition element and said evaporating heating element is made of titanium nitride material, preferably $Al_2O_3$/TiN.

7. An evaporator assembly unit in accordance with claim 1, wherein at least one of said ignition element and said evaporating heating element comprises $Al_2O_3$/TiN.

8. An evaporator assembly unit in accordance with claim 1, wherein said evaporating medium carrier is made of insulating ceramic material.

9. An evaporator assembly unit in accordance with claim 1, wherein said evaporator medium carrier is made of aluminum oxide.

10. An evaporator assembly unit in accordance with claim 1, wherein said porous evaporator medium is made of one of a metal foam material and a ceramic foam material.

11. An evaporator burner comprising:

an evaporator assembly unit comprising an evaporator medium carrier with a bottom wall, a porous evaporator medium provided on one side of said bottom wall and an electrically excitable disk-shaped ignition element embedded within said bottom wall, said evaporator medium carrier comprising an igniting air inlet opening passing through said bottom wall, wherein said igniting air inlet opening passes through said ignition element; and an electrically excitable evaporating heating element embedded within said bottom wall, said evaporating heating element and said ignition element being positioned essentially in a same embedding plane in said bottom wall such that said ignition element does not extend into said porous evaporator medium, said evaporator heating element for heating and evaporating a liquid fuel in said porous evaporator medium.

12. An evaporator burner in accordance with claim 11, wherein a material thickness of said bottom wall between said evaporating heating element and a surface of said bottom wall, which surface is formed on one side, essentially corresponds to a material thickness of said bottom wall between said ignition element and said surface of said bottom wall.

13. An evaporator burner in accordance with claim 11, wherein:

said bottom wall comprises a liquid inlet opening area; and said evaporating heating element comprises a ring segment shape and at least partially surrounds said liquid inlet opening area.

14. An evaporator burner in accordance with claim 13, wherein:

said ring segment shape of said evaporating heating element provides a ring segment interruption area; and said ignition element is arranged in said ring segment interruption area of said evaporating heating element.

15. An evaporator burner in accordance with claim 11, wherein said evaporating heating element and said ignition element are positioned essentially in a same embedding plane in said bottom wall, said electrically excitable ignition element being arranged between one portion of said electrically excitable evaporating heating element and another portion of said electrically excitable evaporating heating element with respect to a circumferential direction of said evaporator medium carrier.

16. An evaporator assembly unit in accordance with claim 1, wherein said evaporating heating element and said ignition element are positioned essentially in a same embedding plane in said bottom wall, said electrically excitable ignition element being arranged between one portion of said electrically excitable evaporating heating element and another portion of said electrically excitable evaporating heating element with respect to a circumferential direction of said evaporator medium carrier.

* * * * *